US005513604A

United States Patent [19]

Clement

[11] Patent Number: 5,513,604

[45] Date of Patent: May 7, 1996

[54] VALVE COVER FOR HIGH PERFORMANCE ENGINES HAVING INTEGRAL OIL PASSAGES

[75] Inventor: Richard H. Clement, LaGrange Park, Ill.

[73] Assignee: Midwest Rim & Wheel Co., Inc., Chicago, Ill.

[21] Appl. No.: 419,895

[22] Filed: Apr. 11, 1995

[51] Int. Cl.[6] ..... F01M 9/10

[52] U.S. Cl. ..... 123/90.38; 184/6.9

[58] Field of Search ..... 123/90.33, 90.38; 184/6.5, 6.9

[56] References Cited

U.S. PATENT DOCUMENTS

| | | | |
|---|---|---|---|
| 1,478,094 | 12/1923 | Barrett | 184/6.9 |
| 1,938,042 | 12/1933 | Robinson | 184/6.9 |
| 1,938,506 | 12/1933 | Wellman | 184/6.9 |
| 3,008,544 | 11/1961 | Krizman | 184/6.9 |
| 4,911,120 | 3/1990 | Sumi | 123/90.38 |

FOREIGN PATENT DOCUMENTS

| | | | |
|---|---|---|---|
| 212981 | 3/1987 | European Pat. Off. | 123/90.33 |

*Primary Examiner*—Weilun Lo
*Attorney, Agent, or Firm*—Banner & Allegretti, Ltd.

[57] ABSTRACT

An internal combustion engine has a valve cover enclosing a plurality of rocker arm assemblies and associated valve stems and springs. The valve cover is provided with an integral manifold that is supplied with pressurized lubricant. There is at least one opening from the manifold to each rocker arm assembly. Within each opening is a jet body that supplies lubricant under high pressure directly onto an associated rocker arm assembly and associated valve stem and valve spring.

3 Claims, 2 Drawing Sheets

VALVE COVER FOR HIGH PERFORMANCE ENGINES HAVING INTEGRAL OIL PASSAGES

BACKGROUND OF THE INVENTION

This invention pertains to a pressurized lubrication system for lubricating the components within the valve cover of an internal combustion engine and more particularly, a high performance internal combustion engine.

In high performance internal combustion engines where the average RPM may be on the order of 5000–7000 RPM (as compared to a conventional internal combustion engine where the average RPM may be on the order of 2500–3000 RPM), it is not only desirable but a necessity to provide adequate lubrication to the rocker assemblies and valve stems of each engine. Should there be inadequate lubrication the valve might overheat and stick and the internal combustion engines might be damaged or even destroyed for all practical purposes.

There have been suggestions in the prior art for lubricating the valves, valve stems, rocker arms and like components within the valve cover of an internal combustion engine however, none of the prior art presently known is suggestive of the pressurized lubricating system of the present invention. Barrett U.S. Pat. No. 1,478,094 shows a perforated pipe in a cover or casing for dripping oil onto parts to be lubricated. Layman U.S. Pat. No. 1,491,710 reveals a lubricating system for an internal combustion engine that includes a plurality of reservoirs and a wick associated with each reservoir. Baxter U.S. Pat. No. 1,916,248 pertains to a system for both cleaning and lubricating the valve stems in an engine. The arrangement of Baxter includes a lubricant reservoir 3 and a lubricant vapor chamber 4, the reservoir having nozzles 5 and the chamber provided with orifices 6. Wellman U.S. Pat. No. 1,938,506 reveals a valve guide lubricator comprising a distributor pipe 25 with a plurality of downwardly directed apertures 33 therein. When the engine is operating, a portion of the oil delivered to the oil distributor is forced into distributor pipes 25, where it is permitted to escape through the apertures 33 arranged one above each of the valve stems 9. Ullrich U.S. Pat. No. 2,057,123 discloses an arrangement for lubricating and cooling engine vanes by utilizing solely the intake suction developed by the pistons reciprocating in their cylinders. Fulton U.S. Pat. No. 2,881,863 relates to apparatus for oiling overhead valves of an engine comprising a tray 36 having a plurality of holes 64, 65 therein for permitting gravity feed of oil onto parts to be lubricated.

SUMMARY OF THE INVENTION

To overcome the shortcomings of the known prior art devices, there has been provided by the present invention a pressurized lubricating for forcing lubricant under pressure from a manifold in the valve cover through jet orifices onto the vane stems and rocker arm assemblies to be lubricated and/or cooled. More specifically, the jet orifices are defined at the end of a longitudinal passageway in a jet body that communicates with the manifold via a transverse opening in the jet body. Each jet body is joined to the valve cover via an opening therein which is plugged or sealed by the jet body.

BRIEF DESCRIPTION OF THE DRAWING

There is shown in the attached drawing a presently preferred embodiment of the present invention, wherein like numbers refer to like elements in the various vies and wherein.

DETAILED DESCRIPTION OF THE PRESENT INVENTION

Figure 5:
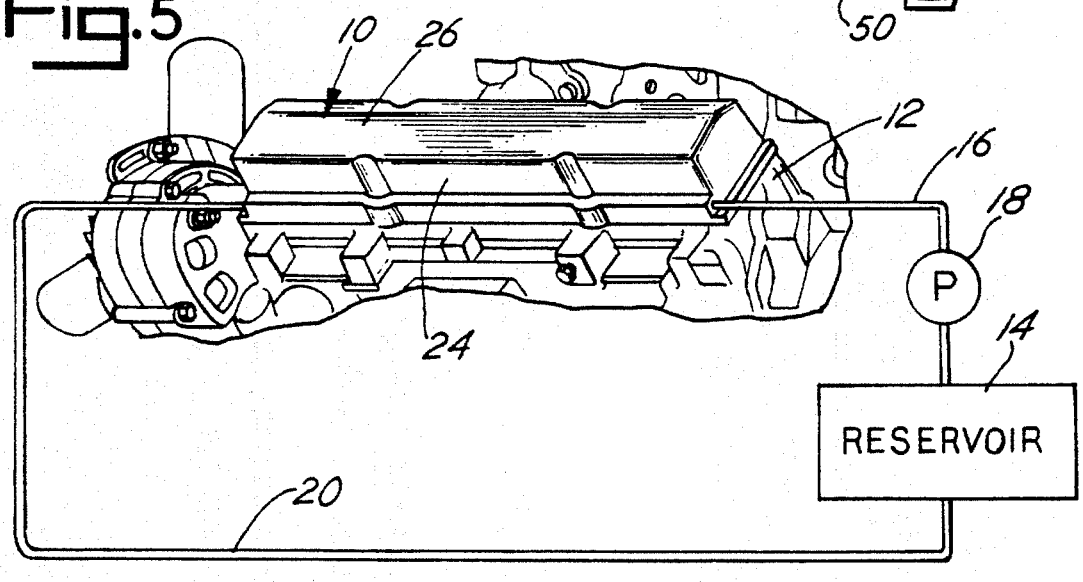
FIG. 5 is a perspective view showing the valve cover in place on a representative internal combustion engine.

There is shown in FIGS. 1 through 4 the valve cover with integral manifold and jet discharge orifices of the present invention. FIG. 5 shows the valve cover on a typical internal combustion engines and also shows somewhat schematically the lubricant reservoir and the pump for pressurizing the flow of lubricant from the reservoir to the jet discharge orifices in the valve cover.

Turning now to FIG. 5 there is shown the valve cover 10 in place on an internal combustion engine 12. Lubricating oil is drawn from lubricant reservoir 14 via a supply line 16 by pump 18, which may be a standard oil pump. Excess lubricant may be returned via return line 22 to the lubricant reservoir 13. At least five pounds per square inch of oil pressure is required to pump enough oil through the jet discharge orifices to provide adequate lubrication.

Figure 1:
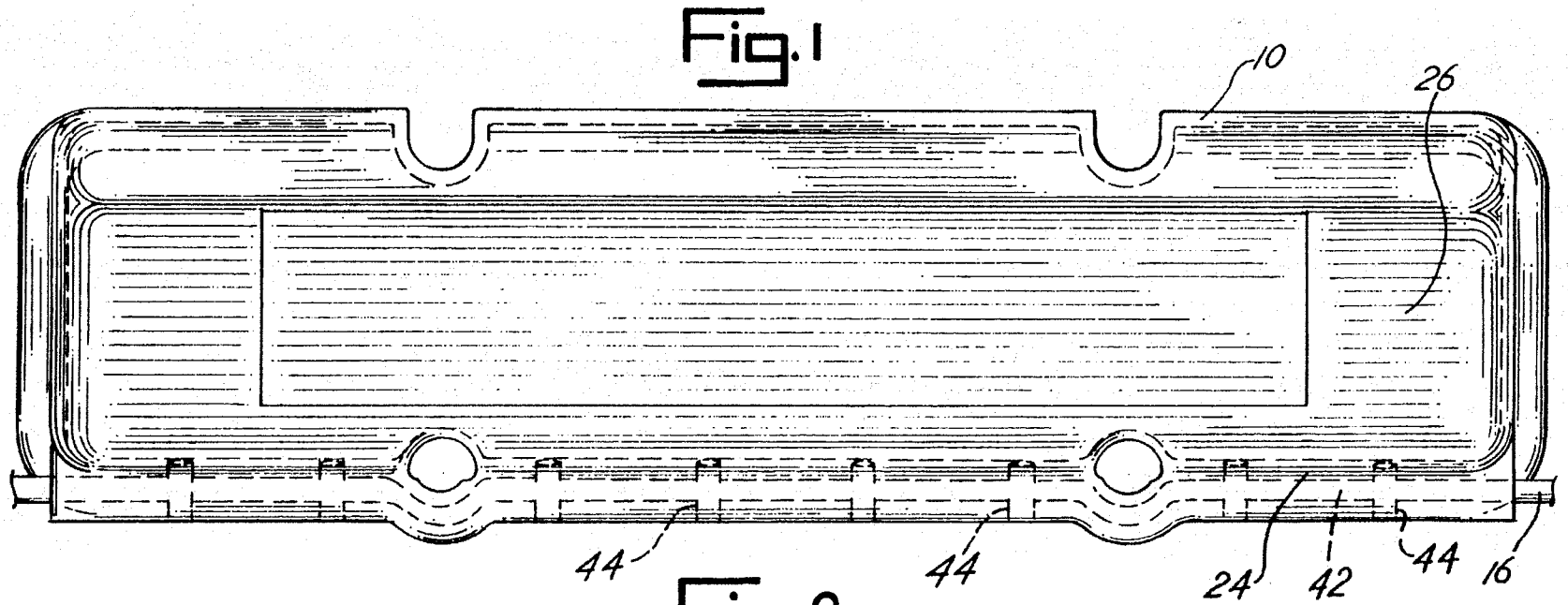
FIG. 1 is a plan view of the valve cover of the present invention.
Figure 2:
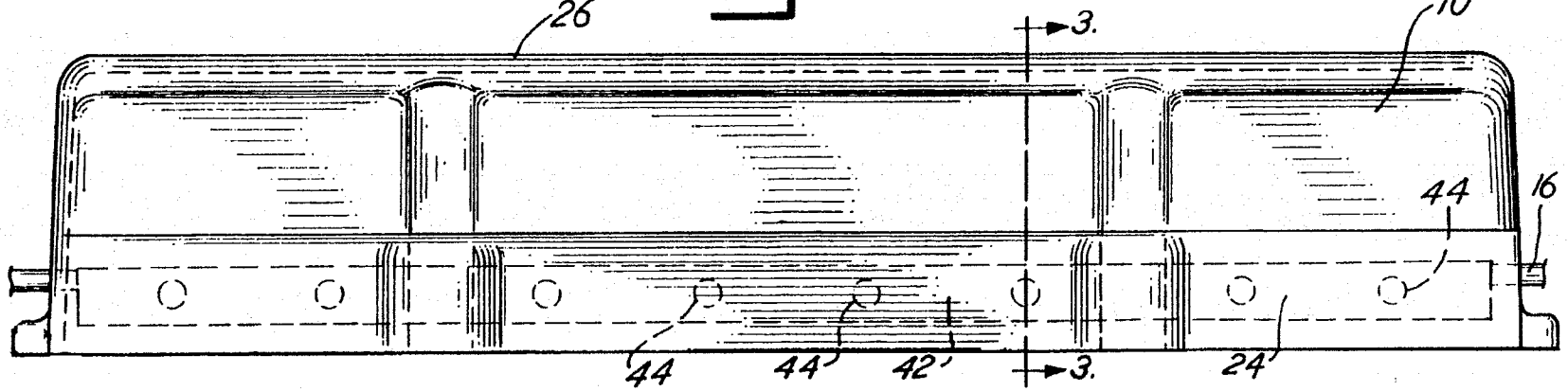
FIG. 2 is a side view of the valve cover of the present invention.
Figure 3:
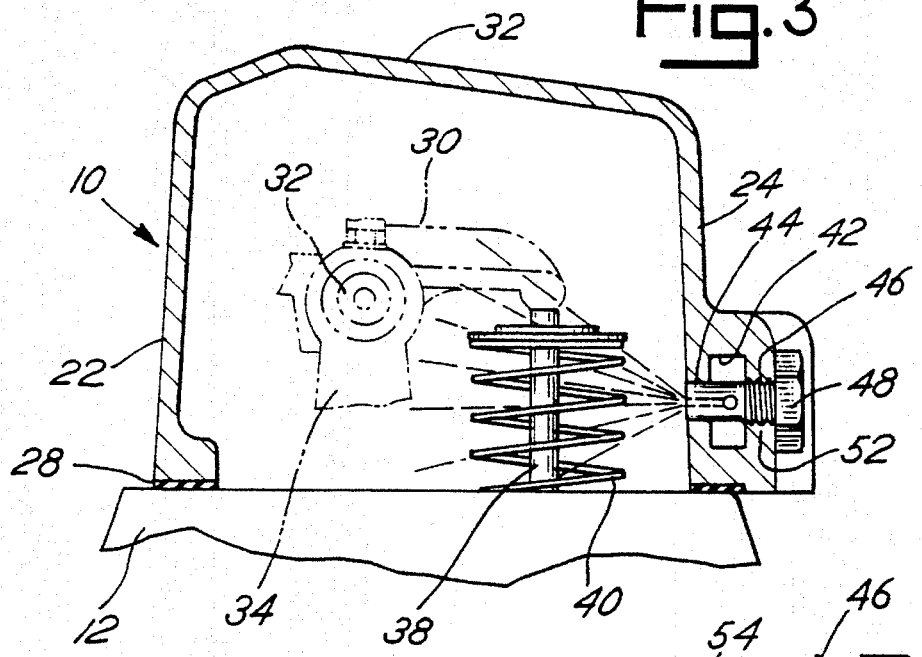
FIG. 3 is a cross-sectional view of the valve cover taken generally along the line 3—3 of FIG. 2 and illustrating a jet body and an associated rocker arm assembly and valve stem and valve spring.
Figure 4:
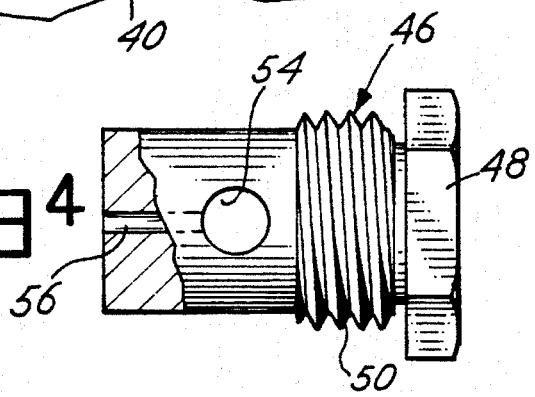
FIG. 4 is a detail view of a jet body, with parts broken away to assist in understanding the construction thereof.

The valve cover 10, which is better seen in FIGS. 1, 2 and 3, includes side walls 22 and 24 which are joined by a top wall 26. The bottom is open and is adapted to be sealed to the engine 12 in a normal fashion by gasket 28. Within the valve cover 10, which may be formed or cast of suitable metal, are disposed the rocker arm assembly comprising rocker arm 30, rocker shaft 32 and support 34. The rocker arm assembly or rocker arm means are associated with the valve stems 38 and valve springs 40, which are of conventional design and form no part of the present invention.

Defined within the wall 24 of valve cover 10 is a longitudinally extending manifold or passage 42 for receiving lubricant from the supply line 16. The manifold 42 is provided with a plurality of openings 44 which correspond to the number of cylinders and valve stems within the valve cover 10. Within each opening 44 there is provided a jet body 46 which is in threaded connection with the side wall 24 of the valve cover 10, as best seen in FIG. 3. Each jet body 46 has a head 48 with a number of flattened sides, for example, six, so that the jet body may be threaded and securely retained in the wall 24 of the valve cover 10. The external threads 50 on the jet body 46 unite with complementary threads 52 in the wall 24 of the valve cover 10 and mate therewith in a sealing relationship.

Extending through the jet body 46 and transverse to the longitudinal axis thereof is an opening 54. The opening 54 communicates with a passage 56 which is longitudinally disposed within the jet body 46. The longitudinal passage 56 defines an orifice which is in alignment with a rocker arm assembly 30, 32, 34 and with a valve stem 38 and valve spring 40. In a presently preferred form of the invention, the diameter of the opening 54 is on the order of 0.150 inch and the diameter of the passage 56 is on the order of 0.040 inch.

In operation, oil or lubricant is supplied to manifold 42 under pressure by pump 18 and is forced into the opening 54 of each of the jet bodies 46. The oil or lubricant flows first transversely and then longitudinally in the jet body 46 and is discharged as a jet through the orifice at the end of the passageway 56, specifically onto the associated valve stem and valve spring and rocker arm assembly. By this arrangement the lubricant is applied directly to the associated engine components so as to adequately lubricate and cool them. The pressurization assures that there is an adequate supply of lubricant throughout the cycle of operation of the engine to prevent damage to any of the operating engine components within the valve cover 10, even under extreme temperature conditions, as occurs in high performance internal combustion engines.

While I have shown a presently preferred embodiment of the present invention, it will be apparent to persons skilled in the art that the invention may be otherwise embodied within the scope of the attached claims.

What is claimed is:

1. In an internal combustion engine having a plurality of rocker arm assemblies and valve stems with springs and a valve cover covering said rocker arm assemblies and valve stems with springs, the improvement comprising pressurized means for lubricating said rocker arm assemblies and valve stems with springs, said pressurized means comprising a manifold formed in said valve cover, openings communicating with the interior of said valve cover formed in said manifold, at least one of said opening for each rocker arm assembly and associated valve stem and spring, a reservoir for lubricant, supply and return conduits connecting the manifold to said reservoir, and pump means in the supply conduit for pressuring the lubricant flow to the openings, wherein lubricant under pressure is fed through each of said openings to an associated rocker arm assembly and valve stem and valve spring within the valve cover, including a jet body secured to the valve cover in each of said openings and extending through the manifold, the jet body having a transverse opening communicating with the lubricant in the manifold, and a longitudinal passage in the jet body having a jet orifice defined at one end, wherein lubricant, under pressure in the manifold, can enter the jet body via the transverse opening therein and the longitudinal passageway and be discharged from the jet orifice onto the associated rocker arm assembly and valve stem and valve spring under pressure.

2. An internal combustion engine as in claim 1 wherein the lubricant pressure in the manifold is at least five pounds per square inch.

3. An internal combustion engine as in claim 1 wherein said engine is a high performance engine operating at an average RPM on the order of 5000–7000 RPM.

* * * * *